US009155401B1

(12) United States Patent
Wergedal

(10) Patent No.: US 9,155,401 B1
(45) Date of Patent: Oct. 13, 2015

(54) TOOL TO FACILITATE THE INSTALLATION OF AN ELASTIC FITTED SHEET ONTO A BED MATTRESS

(71) Applicant: Dayna Elizabeth Wergedal, Rocklin, CA (US)

(72) Inventor: Dayna Elizabeth Wergedal, Rocklin, CA (US)

( * ) Notice: Subject to any disclaimer, the term of this patent is extended or adjusted under 35 U.S.C. 154(b) by 252 days.

(21) Appl. No.: 13/794,793

(22) Filed: Mar. 14, 2013

Related U.S. Application Data

(60) Provisional application No. 61/610,875, filed on Mar. 14, 2012.

(51) Int. Cl.

| | |
|---|---|
| ***A47C 21/02*** | (2006.01) |
| ***A47C 31/00*** | (2006.01) |
| ***B25B 33/00*** | (2006.01) |
| ***B25B 27/14*** | (2006.01) |

(52) U.S. Cl.
CPC ..... *A47C 31/00* (2013.01); *A47C 21/028* (2013.01); *B25B 27/14* (2013.01); *B25B 33/00* (2013.01)

(58) Field of Classification Search
CPC .... A47C 21/028; A47C 21/022; A47C 21/02; A47C 21/00; A47C 31/00; B25B 9/00; B25B 33/00; Y10T 24/23; Y10T 24/44692; Y10T 16/44; Y10T 16/476; B25G 1/00; B25G 1/10; B25G 1/102; B25F 1/00
USPC ..... 5/488, 482, 658–660, 692, 690, 498; D6/607; D8/47, 14; 81/488, 489; 7/103, 105, 166, 169; 24/72.5
See application file for complete search history.

(56) References Cited

U.S. PATENT DOCUMENTS

| | | | | | |
|---|---|---|---|---|---|
| 561,499 | A | * | 6/1896 | Detert | 254/25 |
| 1,518,259 | A | * | 12/1924 | Filiatreault | 16/422 |
| 2,281,736 | A | * | 5/1942 | Wittenburg | 81/488 |
| 2,774,178 | A | * | 12/1956 | Nelson | 81/488 |
| 2,871,848 | A | * | 2/1959 | Wall et al. | 126/215 |
| D194,596 | S | * | 2/1963 | Reid | D6/607 |
| 3,551,016 | A | * | 12/1970 | Hooper | 294/25 |
| D246,345 | S | * | 11/1977 | Poncia | D8/14 |
| D268,073 | S | * | 3/1983 | Schaeffer | D8/14 |
| D268,804 | S | * | 5/1983 | Bacon | D8/14 |
| D275,540 | S | * | 9/1984 | Barkow | D8/14 |
| 4,686,726 | A | * | 8/1987 | Dunfee | 5/485 |
| 4,745,650 | A | * | 5/1988 | Elliott | 5/673 |
| 5,011,203 | A | * | 4/1991 | Tackett | 292/343 |
| D362,376 | S | * | 9/1995 | Oaks | D8/19 |
| 5,459,897 | A | * | 10/1995 | Wurdack | 7/166 |
| D493,078 | S | * | 7/2004 | McGee et al. | D8/14 |
| 6,886,203 | B2 | * | 5/2005 | Drakos et al. | 5/660 |
| 7,398,569 | B2 | * | 7/2008 | Sakaldasis et al. | 5/488 |
| 7,581,270 | B1 | * | 9/2009 | Levesque | 5/660 |

(Continued)

*Primary Examiner* — Robert G Santos

(57) ABSTRACT

A tool to facilitate the installation of an elastic fitted sheet onto a bed mattress comprising a rigid, concave shaped handle neck, a circular, convex shaped base that hooks the last corner of the fitted sheet, an angled wing that guides the elastic over the edge of the mattress and an ergonomic handle to pull (or push) the sheet corner over the edge of the mattress. The tool is constructed of a smooth, rigid material and the handle and back section of the tool is preferably covered with a high friction material in the form of a contoured rubber or elastomeric material. The handle can be held in a forehand grip to pull the sheet or in a backhand grip to push the sheet over the edge of bed mattress. The tool provides the leverage needed to install a fitted sheet and thereby, relieves strain on a person's body, including the fingernails, fingers, hands, arms, shoulders, neck, back, and legs.

7 Claims, 4 Drawing Sheets

(56) References Cited

U.S. PATENT DOCUMENTS

| | | | | |
|---|---|---|---|---|
| 7,596,822 | B2 * | 10/2009 | Sakaldasis et al. | 5/658 |
| 7,707,669 | B1 * | 5/2010 | Richardson | 5/660 |
| 7,730,567 | B2 * | 6/2010 | Jaeger | 5/658 |
| D622,569 | S * | 8/2010 | Montross | D8/47 |
| 7,818,837 | B2 * | 10/2010 | Gonser, Jr. | 5/488 |
| D632,937 | S * | 2/2011 | Montross | D8/47 |
| D660,115 | S * | 5/2012 | Montross | D8/47 |
| 8,191,191 | B2 * | 6/2012 | Montross | 5/660 |
| D701,064 | S * | 3/2014 | Baker et al. | D6/607 |
| D712,179 | S * | 9/2014 | Baker et al. | D6/607 |
| 8,918,931 | B1 * | 12/2014 | Baker et al. | 5/498 |
| 2004/0133985 | A1 * | 7/2004 | Drakos et al. | 5/658 |
| 2007/0271706 | A1 * | 11/2007 | Gonser | 5/658 |
| 2008/0040856 | A1 * | 2/2008 | Adamson et al. | 5/498 |
| 2008/0040858 | A1 * | 2/2008 | Sakaldasis et al. | 5/658 |
| 2008/0040859 | A1 * | 2/2008 | Harris-Adamson et al. | 5/658 |
| 2008/0222814 | A1 * | 9/2008 | Jaeger | 5/658 |
| 2011/0099713 | A1 * | 5/2011 | Gonser, Jr. | 5/488 |
| 2011/0179578 | A1 * | 7/2011 | Montross | 5/660 |

* cited by examiner

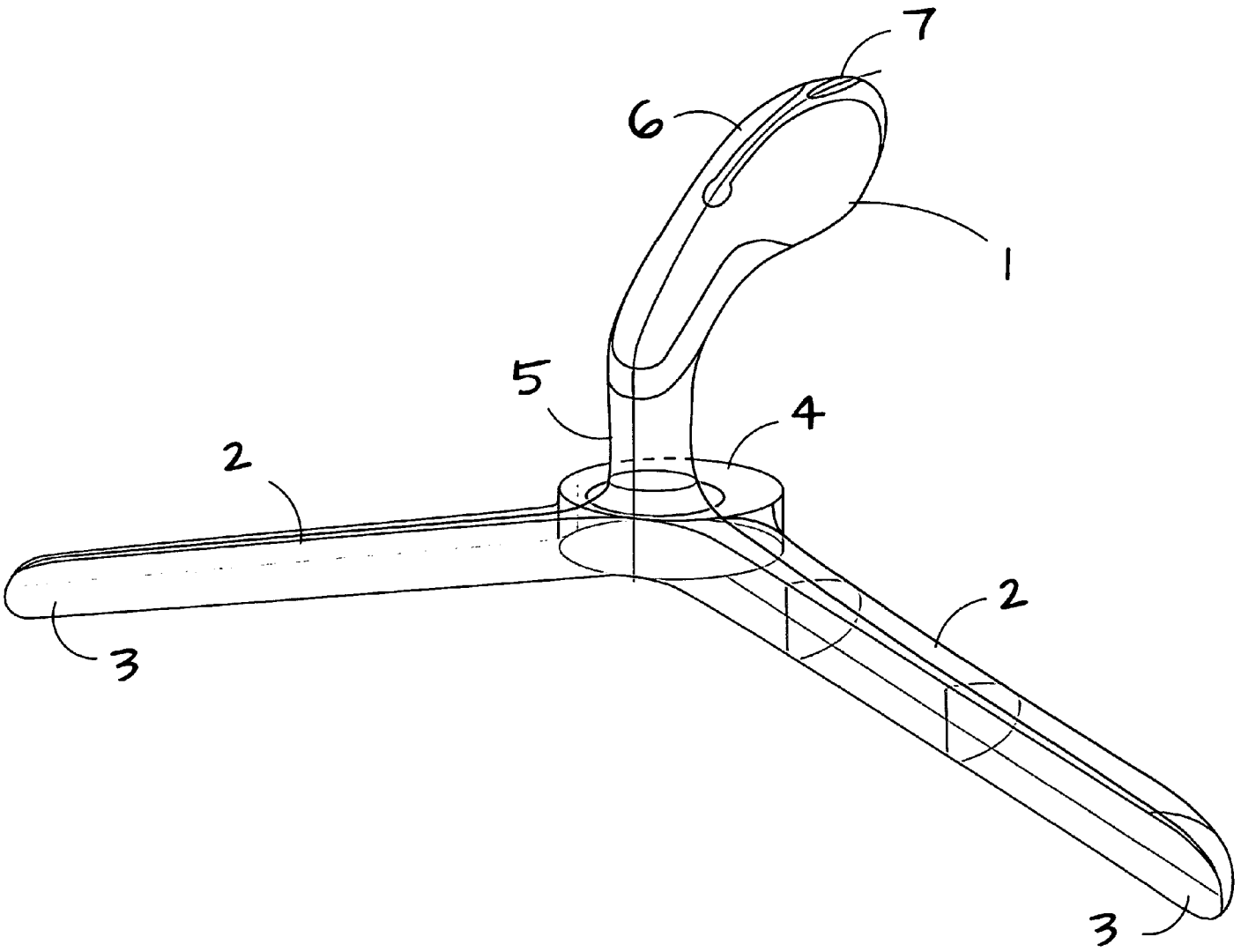
FIG. 1 ANGLE VIEW

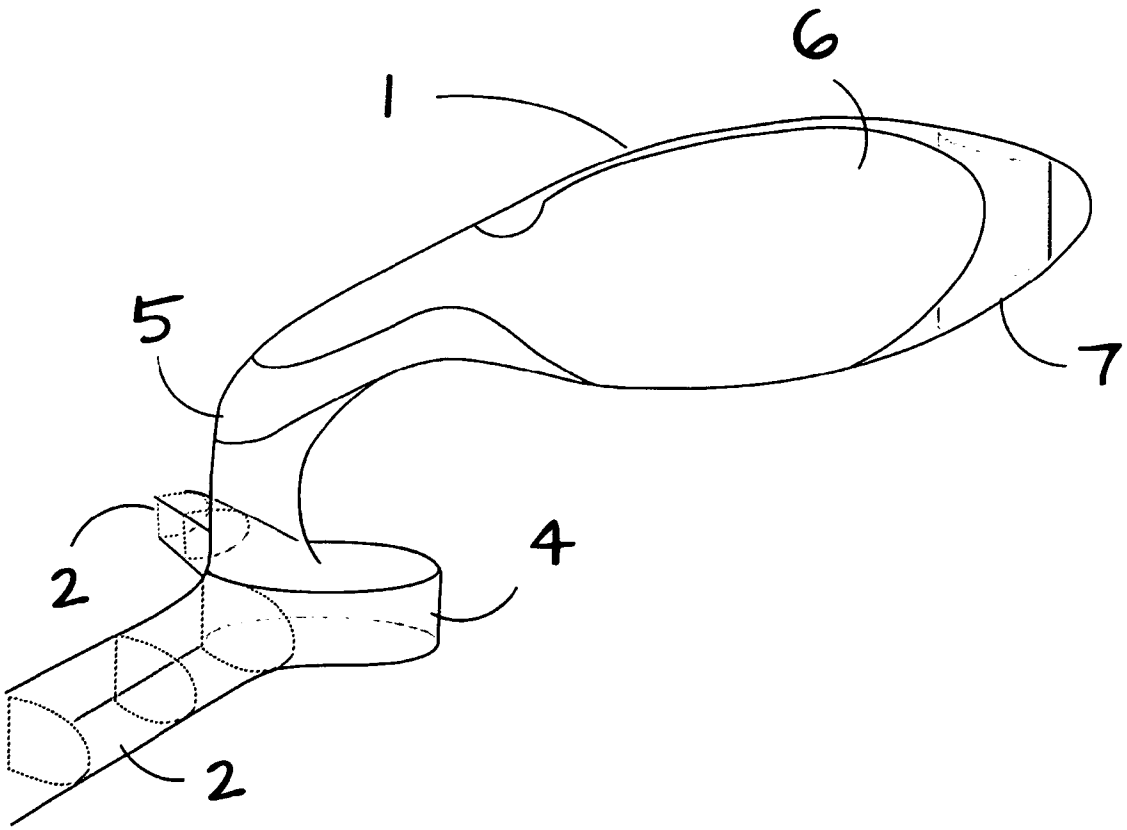
FIG. 2 SIDE VIEW

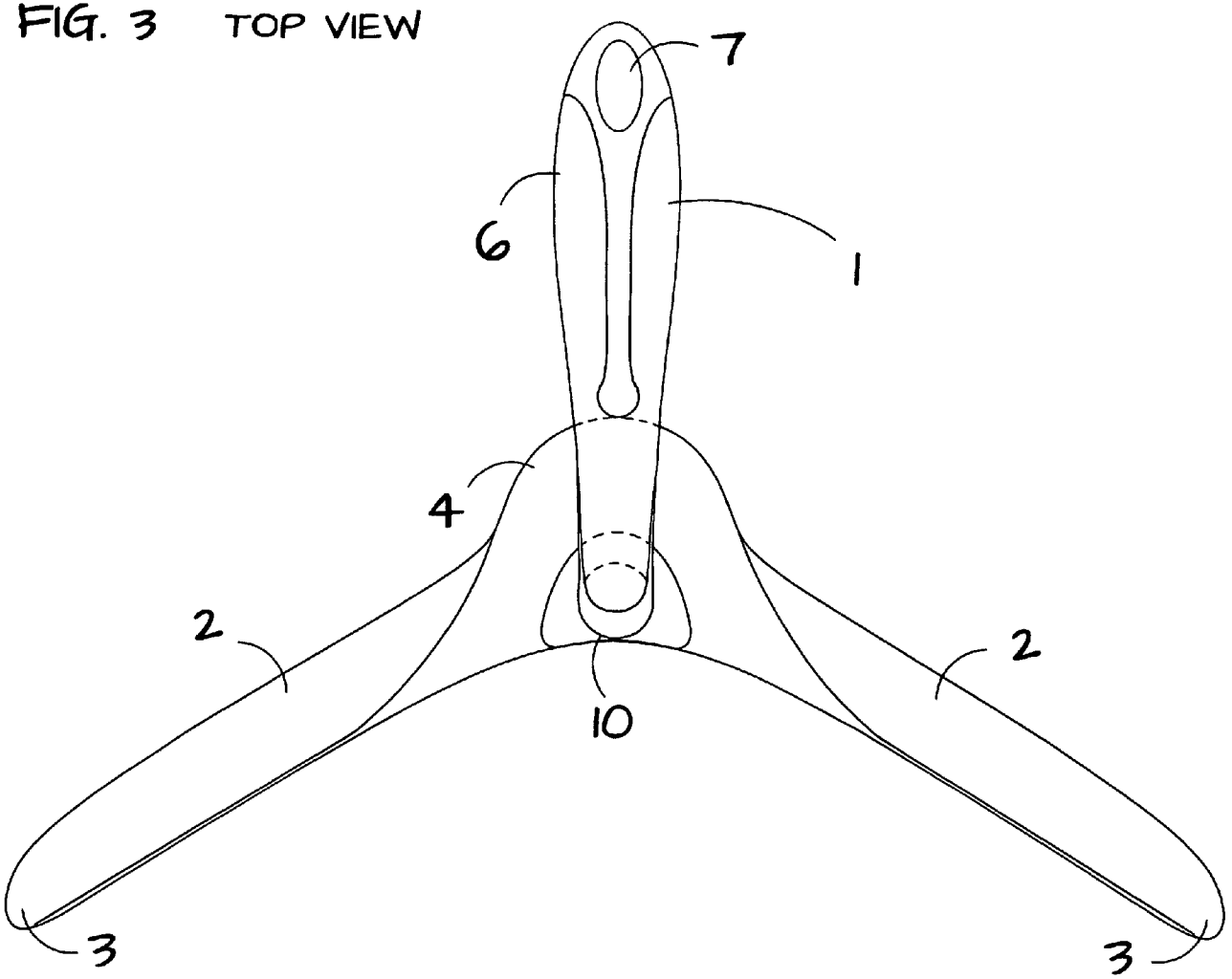
FIG. 3 TOP VIEW

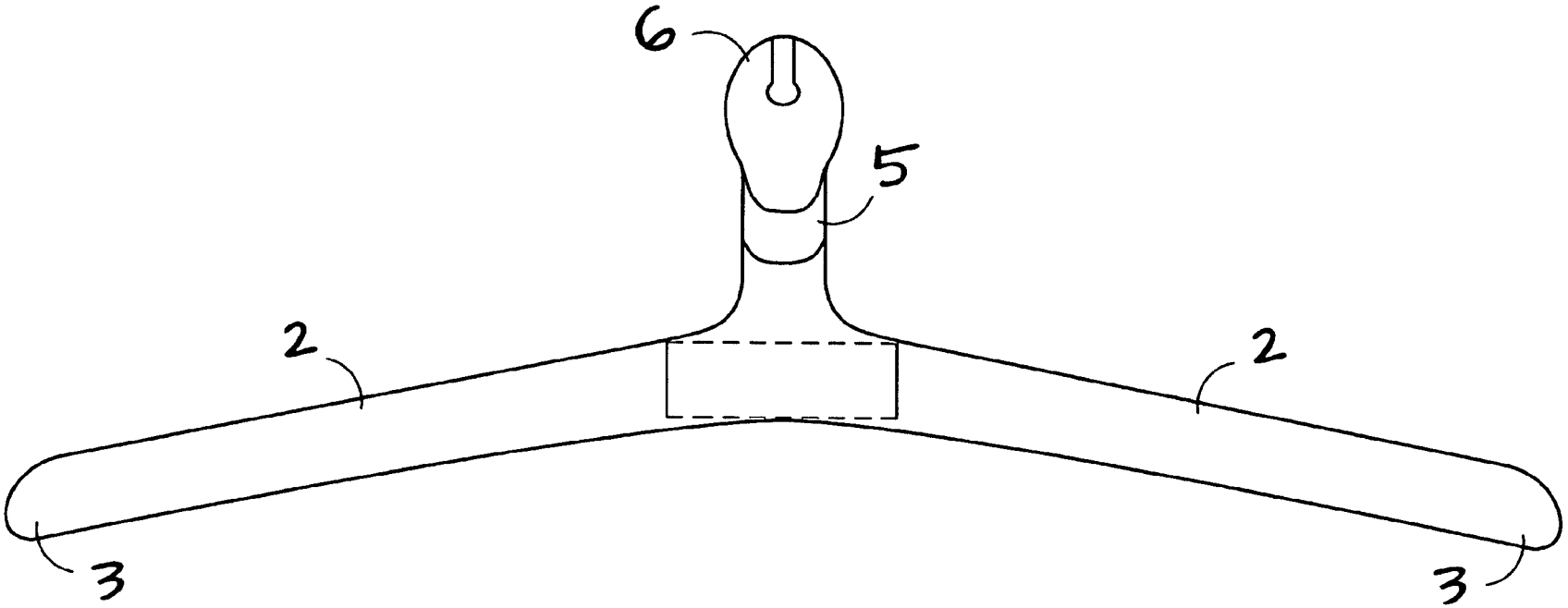
FIG. 4 FRONT VIEW

TOOL TO FACILITATE THE INSTALLATION OF AN ELASTIC FITTED SHEET ONTO A BED MATTRESS

BACKGROUND OF THE INVENTION

Problem Solved

Fitted sheets are difficult to fit onto a bed mattress especially when mattresses are overstuffed or when fitted sheets shrink from being laundered.

There is no product that exists in its field. When a person pulls an elastic fitted sheet over the last (or final) corner of a bed mattress, they struggle to hold their grip, damage their fingernails and experience strain in their fingers, hands, arms shoulders, neck, back and legs.

There is no product that exists in its field.

DETAILED DESCRIPTION OF THE INVENTION

As stated above, fitted sheets are difficult to fit on to a bed mattress especially when mattresses are overstuffed or when fitted sheets shrink from being laundered. The invention claimed here solves this problem.

My invention, which may be called the "Grip-n-Fit", is a tool that makes it easy to pull the last (or final) elastic fitted sheet corner over the edge of a mattress corner. It helps to relieve the strain on a person's body and provides additional leverage needed to pull an elastic fitted sheet over the edge of a bed mattress.

The claimed invention differs from what currently exists. There is no product that exists in its field. This invention facilitates an easier way to fit an elastic fitted sheet onto a mattress by providing additional leverage and helping to relieve the strain caused by pulling the tight fitting last corner over the edge of a bed mattress.

This invention is an improvement on what currently exists. There is no product that exists in its field. This invention facilitates an easier way to fit an elastic fitted sheet onto a mattress by providing additional leverage and helping to relieve the strain caused by pulling the tight fitting last corner over the edge of a bed mattress.

There is no product that exists in its field.

The Version of the Invention Discussed Here Includes:

1. Grip-n-Fit tool made of durable material and areas could have grip surfaces
2. Wing made of durable material and areas could have grip surfaces
3. Wing Tip made of durable material
4. Hook made of durable material and could have grip surfaces
5. Neck made of durable material and could have grip surfaces
6. Handle made of durable material and could have grip surfaces
7. Hole made with smooth edges running through the (6) Handle
8. Hand Strap made of soft, flexible material See "GnFDrawings.pdf for number references.

Relationship Between the Components:

The (8) Hand Strap may be connected to the (7) Hole on the (6) Handle. A strap can be fed up through the back of the (7) Hole and looped through the opening. It may have an adjustable sizing feature for a more secure fit.

How the Invention Works:

The Grip-n-Fit is a tool that provides an easy way to pull the last (or final) elastic fitted sheet corner over the edge of a mattress corner. It helps to relieve the strain on a person's body and provides the leverage needed to pull an elastic fitted sheet over the edge of a bed mattress.

First, secure three (easiest to access) corners of the elastic fitted sheet onto the mattress. Place the (1) Grip-n-Fit on the last (or final) corner of the elastic fitted sheet. Tuck the (2) Wings into the elastic and place (4) Hook into the corner of the sheet. While holding the (6) Handle, pull the (1) Grip-n-Fit toward the corner edge of the mattress. Continue pulling the (1) Grip-n-Fit over the top edge of the mattress and slide it down towards the bottom edge. As the (2) Wings guide the sheet over the edge, the elastic is fitted onto the bed mattress and the (2) Wings are released from the elastic at the bottom of the mattress corner.

How to Make the Invention:

To make this invention, one could make an injection mold of the (1) Grip-n-Fit invention based on the drawing specifications. The (2) Wing is, preferably, shaped as shown in the drawing, but could take other shapes, such as cylindrical or tubular. The grip material could be added after the mold is completed. It could be made with a variety of materials, including plastic, wood and metal. Adding the grip material is the preferred design element for optimum product usability, but is not necessary.

The (2) Wing, (3) Wing Tip, (4) Hook, (5) Neck and (6) Handle are necessary features of this invention. The optional element is the (8) Hand Strap.

How to Use the Invention:

First, secure three (easiest to access) corners of the elastic fitted sheet onto the mattress. Place the (1) Grip-n-Fit on the last (or final) corner of the elastic fitted sheet. Tuck the (2) Wings into the elastic and place (4) Hook into the corner of the sheet. While holding the (6) Handle, pull the (1) Grip-n-Fit toward the corner edge of the mattress. Continue pulling the (1) Grip-n-Fit over the top edge of the mattress and slide it down towards the bottom edge. As the (2) Wings guide the sheet over the edge, the elastic is fitted onto the bed mattress and the (2) Wings are released from the elastic at the bottom of the mattress corner.

BRIEF DESCRIPTION OF DRAWINGS

FIG. 1 is the Angle View of the tool that facilitates the installation of an elastic fitted sheet onto a bed mattress.

FIG. 2 is the Side View of the tool that facilitates the installation of an elastic fitted sheet onto a bed mattress.

FIG. 3 is the Top View of the tool that facilitates the installation of an elastic fitted sheet onto a bed mattress.

FIG. 4 is the Front View of the tool that facilitates the installation of an elastic fitted sheet onto a bed mattress.

The invention claimed is:

1. A tool to facilitate the installation of an elastic fitted sheet, the tool comprising:

an ergonomic handle member graspable by a human hand;

a concave shaped handle neck that meets a base of the tool;

the base being a convex, circular shaped protruded base that acts as a hook at the base of the handle neck; and an angled wing at the front of the tool in the same plane as the base, wherein the neck generally extends along an axis that is substantially perpendicular to the plane of the angled wing and base.

2. The tool of claim 1 wherein the body of the tool is constructed from high quality, durable plastic, wood, metal or other sturdy material and has a smooth finish.

3. The tool of claim 1 wherein the tool is formed into a contoured, cylinder, solid, hollow or other shapes.

4. The tool of claim 1 wherein a back of the tool and the handle member is preferably covered with a high friction grip material in the form of a contoured rubber or elastomeric material.

5. The tool of claim 1 wherein the handle member can be held in a forehand grip to pull the sheet or in a backhand grip to push the sheet over the edge of a bed mattress.

6. The tool of claim 1 wherein the wing is angled to the shape of a mattress corner and has a contoured tip to facilitate the installation of and release from the elastic fitted sheet.

7. The tool of claim 1 wherein the handle member includes a cylindrical shaped hole to allow an optional wrist strap or hanging strap to be attached.

* * * * *